US008974996B2

(12) United States Patent
Yoshie et al.

(10) Patent No.: US 8,974,996 B2
(45) Date of Patent: Mar. 10, 2015

(54) LIQUID DEVELOPER

(71) Applicants: Naoki Yoshie, Ibaraki (JP); Kenji Hayashi, Hachioji (JP); Chiaki Yamada, Ibaraki (JP); Keiko Momotani, Ibaraki (JP); Masahiro Anno, Sakai (JP); Yuya Kubo, Hachioji (JP); Miyuki Hotta, Kobe (JP)

(72) Inventors: Naoki Yoshie, Ibaraki (JP); Kenji Hayashi, Hachioji (JP); Chiaki Yamada, Ibaraki (JP); Keiko Momotani, Ibaraki (JP); Masahiro Anno, Sakai (JP); Yuya Kubo, Hachioji (JP); Miyuki Hotta, Kobe (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 0 days.

(21) Appl. No.: 13/666,780

(22) Filed: Nov. 1, 2012

(65) Prior Publication Data

US 2013/0115552 A1 May 9, 2013

(30) Foreign Application Priority Data

Nov. 4, 2011 (JP) ..... 2011-242104

(51) Int. Cl.

| | |
|---|---|
| ***G03G 9/13*** | (2006.01) |
| ***G03G 9/135*** | (2006.01) |
| ***G03G 9/12*** | (2006.01) |

(52) U.S. Cl.

CPC ..... *G03G 9/1355* (2013.01); *G03G 9/132* (2013.01); *G03G 9/122* (2013.01)

USPC ..... 430/114; 430/115

(58) Field of Classification Search

CPC ..... G03G 9/122; G03G 9/132; G03G 9/1355

USPC ..... 430/114, 115

See application file for complete search history.

(56) References Cited

U.S. PATENT DOCUMENTS

| | | | | |
|---|---|---|---|---|
| 4,052,325 | A * | 10/1977 | Santilli | 430/114 |
| 5,320,924 | A * | 6/1994 | Shintaku et al. | 430/108.2 |
| 5,968,244 | A * | 10/1999 | Ueda et al. | 106/31.86 |
| 7,809,295 | B2 * | 10/2010 | Yasukawa et al. | 399/57 |
| 7,851,117 | B2 * | 12/2010 | Yodo et al. | 430/115 |
| 2008/0311505 | A1 | 12/2008 | Akioka | |
| 2009/0035458 | A1 * | 2/2009 | Yoshie | 427/145 |
| 2010/0136475 | A1 * | 6/2010 | Iwase et al. | 430/116 |

FOREIGN PATENT DOCUMENTS

| | | | |
|---|---|---|---|
| CN | 101203813 | A | 6/2008 |
| EP | 2 192 450 | A1 | 6/2010 |
| JP | 03-271752 | A | 12/1991 |
| JP | 05-333607 | A | 12/1993 |
| JP | 2009-053638 | A | 3/2009 |
| JP | 2009-057399 | A | 3/2009 |
| JP | 2009-122186 | A | 6/2009 |
| WO | 2010/106874 | A1 | 9/2010 |

OTHER PUBLICATIONS

ProQuest Dialog machine-assisted English-language translation of WO 2010/106874 A1 (pub. Sep. 2010).*

Extended European Search Report dated Jan. 30, 2013, issued by European Patent Office in corresponding European Patent Application No. 12191065.7. (6 pages).

Notice of Ground of Rejection issued on Oct. 22, 2013, by the Japanese Patent Office in corresponding Japanese Patent Application No. 2011-242104, and an English Translation of the Notice. (4 pages).

Office Action (Grounds for Rejection) issued Feb. 13, 2014 in corresponding Chinese Application No. 201210432122.9 with an English translation thereof. (13 pgs).

* cited by examiner

*Primary Examiner* — Janis L Dote

(74) *Attorney, Agent, or Firm* — Buchanan Ingersoll & Rooney PC

(57) ABSTRACT

A liquid developer used for wet-type image forming apparatuses includes toner particles and an insulating liquid, the toner particles include a resin, a pigment, and a pigment dispersant, the pigment includes a pigment having an acid group, and the pigment dispersant is a basic polymer dispersant including units derived from ϵ-caprolactone.

3 Claims, 1 Drawing Sheet

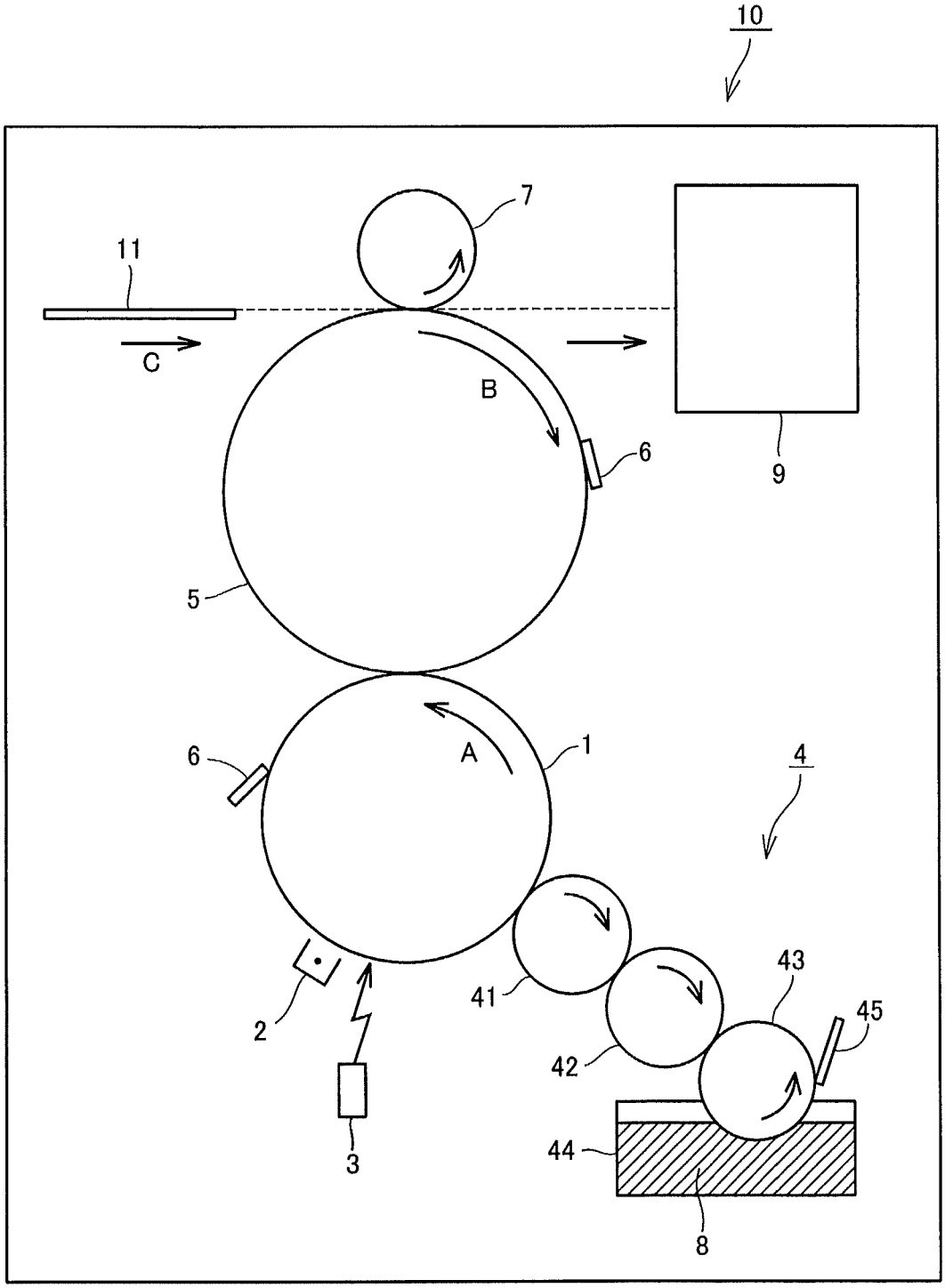
10
7
11
C
B
6
9
5
6
A
1
4
2
41
43
45
42
3
44
8

LIQUID DEVELOPER

This application is based on Japanese Patent Application No. 2011-242104 filed with the Japan Patent Office on Nov. 4, 2011, the entire content of which is hereby incorporated by reference.

BACKGROUND OF THE INVENTION

1. Field of the Invention

The present invention relates to a liquid developer used for wet-type image forming apparatuses based on wet electrophotography, such as copying machine, printer, digital printing machine, and the like.

2. Description of the Related Art

A liquid developer is composed of a toner particle (fine coloring particle) component and an insulating liquid (carrier liquid) component, and the toner particle is usually composed of a resin, a pigment, and a pigment dispersant.

The particle size of toner particles of such a liquid developer is smaller than that of a dry developer, and can be reduced to a size on the order of submicrons, and accordingly reduction of the amount of consumed toner particles can be expected. Regarding the toner particles of the liquid developer, however, a higher content of the pigment relative to that of the dry developer is necessary, and therefore, the pigment dispersant is added. Addition of the pigment dispersant improves compatibility between the pigment and the resin in the toner particle.

For example, Japanese Laid-Open Patent Publication No. 2009-053638 discloses a liquid developer including a pigment dispersant which is an amine compound. Japanese Laid-Open Patent Publication No. 05-333607 also discloses a liquid developer for electrostatic charge development that is composed of toner particles dispersed in the presence of an acid pigment derivative, and an electrically insulating liquid.

SUMMARY OF THE INVENTION

In the case where the liquid developer is used to form an image, the fixity of the image is inferior as compared with the dry developer due to the presence of the liquid (insulating liquid). The reason for this is supposed to be that the liquid, together with the image (toner particles), still remains on a recording material such as paper after the fixing process, and acts as a releasing component.

The liquid developer is composed of a toner particle component which is a solid component and a liquid component as described above. The toner particle includes a resin (binder resin) and a pigment. Usually, the resin is melted to be attached to and accordingly fixed on the recording material. In some cases, however, the resin component alone is not enough to provide an adequate fixing strength, and therefore addition of a component which supplements the fixity is desired. It is expected that addition of the pigment dispersant to toner particles will improve the fixing strength.

As such a pigment dispersant, a basic pigment dispersant is particularly expected to improve the fixing strength, and therefore, use of the basic pigment dispersant is desired for improving the fixing strength. The basic pigment dispersant, however, may cause a problem of deteriorated dispersibility of the pigment in the toner particle. In particular, if the pigment is a basic or neutral pigment, adequate dispersibility will not be achieved.

In the case of the granulation method by which toner particles are formed from liquid droplets dispersed in oil, the presence of such a basic pigment dispersant in the droplet may cause the viscosity of the liquid droplet to increase and cause the quality of granulation for toner particles to be degraded.

The present invention has been made in view of the circumstances above, and an object of the invention is to provide a liquid developer by which both the improvement of the dispersibility of the pigment in the toner particle and the improvement of the fixing strength as well as high productivity are achieved.

The liquid developer of the present invention includes toner particles and an insulating liquid, the toner particles include a resin, a pigment, and a pigment dispersant, the pigment includes a pigment having an acid group, and the pigment dispersant is a basic polymer dispersant including units derived from ϵ-caprolactone.

Here, the acid group is preferably sulfonic acid group or carboxylic acid group. It is preferable that the resin includes a polyester resin, the polyester resin includes units derived from an acid component and units derived from an alcohol component, and a total amount of units derived from an aliphatic monomer included in the units derived from an acid component and the units derived from an alcohol component is 30 to 80 mol %.

It is also preferable that the toner particles are obtained by: preparing a two-phase system made up of a dispersed phase and a continuous phase, the dispersed phase is a dispersed liquid in which the pigment is dispersed in a resin solution prepared by dissolving the resin in a first solvent, and the continuous phase is a second solvent; and vaporizing the first solvent from the dispersed phase, the dispersed phase includes the pigment dispersant, and the first solvent has a solubility parameter value different from a solubility parameter value of the second solvent.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 1 is a schematic conceptual view of a wet-type image forming apparatus based on wet electrophotography.

DESCRIPTION OF THE PREFERRED EMBODIMENTS

In the following, an embodiment of the present invention will be described in further detail.

<Liquid Developer>

A liquid developer of the present embodiment includes at least toner particles and an insulating liquid, and the toner particles are dispersed in the insulating liquid. As long as this liquid developer includes these components, the liquid developer may include other arbitrary components. Examples of other components may be toner dispersant (toner dispersant is distinguished from a pigment dispersant included in toner particles as described later herein, in that the toner dispersant is included in the insulating liquid for dispersing the toner particles, and will be referred to herein as "toner dispersant" for the sake of convenience), charge control agent, thickener, and the like.

The ratio between the contents of the components of the liquid developer may for example be 1 to 50 mass % of the toner particles and the remainder of the insulating liquid and arbitrary components if any. If the content of the toner particles is less than 1 mass %, the toner particles are likely to settle, and the stability with time during a long-term storage tends to deteriorate. Moreover, in order to obtain a required image density, a large amount of the liquid developer must be fed and accordingly the amount of the insulating liquid attached to a recording material such as paper increases. In this case, the need arises to dry the insulating liquid in the fixing process and resultant vapor could cause an environmental problem. On the contrary, if the content of the toner particles is more than 50 mass %, the liquid developer has excessively high viscosity. Such a liquid developer tends to difficult to manufacture and handle.

The viscosity of the liquid developer at 25° C. is preferably not less than 0.1 mPa·s and not more than 10000 mPa·s. If the viscosity is higher than 10000 mPa·s, the liquid developer is difficult to stir. In this case, toner particles cannot uniformly be dispersed in the insulating liquid and a heavy burden may be imposed on the apparatus used for obtaining the liquid developer. On the contrary, if the viscosity is lower than 0.1 mPa·s, toner particles are likely to settle, the stability with time during a long-term storage may deteriorate and the image density may be unstable.

The liquid developer as described above is useful as a developer for a wet-type image forming apparatus based on wet electrophotography.

<Toner Particles>

The toner particles included in the liquid developer of the present embodiment include a resin, a pigment, and a pigment dispersant. As long as such toner particles of the present embodiment include a resin, a pigment, and a pigment dispersant, the toner particles may include other arbitrary components. Examples of other components may be wax, charge control agent, and the like.

The toner particles have an average particle size of preferably 0.1 to 5 μm, more preferably 0.5 to 3 μm. It should be noted that the average particle size is herein a volume-average particle size. If the average particle size of the toner particles is smaller than 0.1 μm, the development quality may be deteriorated. If the average particle size of the toner particles is larger than 5 μm, the image quality may be degraded.

In the following, each of the components of the toner particles will further be described.

<Resin>

The resin included in the toner particles of the present embodiment chiefly serves to fix the toner particles (pigment) on a recording material. As the resin, any conventionally known resin used as a resin component of the toner particles can be used without being particularly limited. In particular, a thermoplastic resin is preferred. Examples of such a resin may be polyester resin, styrene acrylic copolymer resin, styrene acrylic modified polyester resin, polyolefin copolymer (particularly ethylene-based copolymer), epoxy resin, rosin modified phenolic resin, rosin modified maleic resin, and the like.

Preferably, the resin of the present embodiment particularly includes a polyester resin, among the above examples of the resin, since an adequate fixing strength is obtained by using the polyester resin. The polyester resin is obtained by polycondensation of polyalcohol and polycarboxylic acid.

In particular, this polyester resin preferably includes units derived from an acid component and units derived from an alcohol component, and the total amount of units derived from an aliphatic monomer that are included in the units derived from an acid component and the units derived from an alcohol component is 30 to 80 mol %, more preferably 50 to 80 mol %. The range of the ratio of the aliphatic monomer is thus defined, since the compatibility between an alkyl group included in the resin and an alkyl group included in the insulating liquid described later herein is accordingly improved and an adequate quality of granulation is accordingly obtained in the process of manufacturing toner particles. The quality of granulation here refers to ease of formation of liquid droplets for the granulation method by which toner particles are formed from liquid droplets dispersed in oil.

Moreover, the range of the ratio of the aliphatic monomer thus defined also produces a beneficial effect of improving the strength of fixing on a recording material such as paper. While the specific mechanism that produces such an effect has not been elucidated, the effect is considered as being produced since the defined range of the ratio and addition of the pigment dispersant described later herein work synergistically to provide low viscosity of the toner particles in a fixing process and improvement of orientation of the resin.

The above-described polyester resin is basically synthesized by a polycondensation reaction between polycarboxylic acid (acid component) and polyalcohol (alcohol component). Therefore, a portion derived from the polycarboxylic acid forms the acid component units (namely units derived from an acid component), a portion derived from the polyalcohol forms the alcohol component units (namely units derived from an alcohol component), and these units are repeated to thereby constitute the polyester resin. Thus, the aliphatic monomer for an acid component unit may be aliphatic polycarboxylic acid, lower alkyl ester thereof, acid anhydride thereof, or the like, and the aliphatic monomer for an alcohol component unit may be aliphatic polyalcohol. Moreover, the total amount of units derived from an aliphatic monomer means the total amount of the units derived from an aliphatic monomer as described above included in both the acid component units and the alcohol component units.

Here, examples of the aliphatic polycarboxylic acid may be oxalic acid, malonic acid, succinic acid, glutaric acid, adipic acid, pimelic acid, suberic acid, azelaic acid, sebacic acid, 1,9-nonane dicarboxylic acid, 1,10-decane dicarboxylic acid, 1,11-undecane dicarboxylic acid, 1,12-dodecane dicarboxylic acid, 1,13-tridecane dicarboxylic acid, 1,14-tetradecane dicarboxylic acid, 1,16-hexadecane dicarboxylic acid, 1,18-octadecane dicarboxylic acid, lower alkyl ester thereof, acid anhydride thereof, and the like. Of these compounds, in terms of improvement of crystallinity of the polyester resin, any of adipic acid, sebacic acid, 1,10-decane dicarboxylic acid, and 1,12-dodecane dicarboxylic acid is preferably used. As such a polycarboxylic acid, one of or a combination of two or more of the above-listed compounds may be used.

Moreover, examples of the aliphatic polyalcohol may be ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,20-eicosanediol, and the like. Of these compounds, in terms of improvement of crystallinity of the polyester resin, any of ethylene glycol, 1,4-butanediol, 1,6-hexanediol, 1,9-nonanediol, and 1,10-decanediol is preferably used. As such an aliphatic polyalcohol, one of or a combination of two or more of the above-listed compounds may be used.

Each of the acid component units and the alcohol component units may include, in addition to the units derived from an aliphatic monomer, units derived from an aromatic monomer, for example. Such an aromatic monomer for an acid component unit may be aromatic polycarboxylic acid, lower alkyl ester thereof, acid anhydride thereof, or the like, and such an aromatic monomer for an alcohol component unit may be aromatic polyalcohol.

Examples of the aromatic polycarboxylic acid may be terephthalic acid, isophthalic acid, orthophthalic acid, t-butyl isophthalic acid, 2,6-naphthalene dicarboxylic acid, 4,4'-biphenyl dicarboxylic acid, trimellitic acid, and the like. Of these compounds, in terms of availability, any of terephthalic acid, isophthalic acid, and t-butyl isophthalic acid is preferably used.

Moreover, the aromatic polyalcohol may for example be an alkylene oxide adduct of bisphenol A expressed by the following formula (I).

(I)

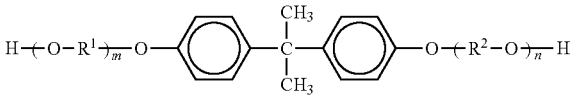

In formula (I), $R^1$ and $R^2$ each independently represent an alkylene group with a carbon number of 2 or 3, m and n each independently represent zero or a positive integer, and the sum of m and n is 1 to 16.

This polyester resin may be synthesized by copolymerization of an aliphatic monomer and an aromatic monomer, or may be prepared by mixture of an aliphatic polyester obtained by copolymerization (polycondensation) of aliphatic monomers only and an aromatic polyester obtained by copolymerization (polycondensation) of aromatic monomers only, where they are mixed when the toner particles are produced. In the case where the aliphatic polyester and the aromatic polyester are mixed and in the case where two or more different types of polyester resins are used, the ratio of the content (mol %) of the units derived from an aliphatic monomer as described above herein refers to the ratio of the content thereof relative to the whole polyester resins (mixture).

Such a polyester resin preferably has a number-average molecular weight (Mn) of not less than 1000 and not more than 5000 and preferably has a weight-average molecular weight (Mw) of not less than 2000 and not more than 200000. It is noted that the number-average molecular weight and the weight-average molecular weight can be measured by means of GPC (Gel Permeation Chromatography).

The ratio of the monomers of the synthesized polyester resin can be determined by using a Fourier transform nuclear magnetic resonance apparatus (FT-NMR) (trademark: "LAMBDA 400" manufactured by JEOL Ltd.) and conducting 1H-NMR analysis to obtain the integration ratio from which the ratio of the monomers is derived. As a solvent for measurement, chloroform-d (deuterated chloroform) solvent may be used.

<Pigment>

The pigment included in the toner particles of the present embodiment is characterized by that the pigment includes a pigment having an acid group. The fact that the pigment thus includes a pigment having an acid group significantly improves the compatibility between the pigment and the pigment dispersant described later herein, which accordingly improves the compatibility between the pigment and the resin to thereby remarkably improve the dispersibility of the pigment in the toner particle. This effect will never be obtained if the pigment includes only a neutral pigment or only a basic pigment. Furthermore, in the case where the pigment thus includes a pigment having an acid group, the granulation method by which toner particles are formed from droplets dispersed in oil can use the droplets whose viscosity is lowered, which is highly advantageous for manufacture of toner particles based on such a granulation method. Usually, use of a basic pigment dispersant tends to cause the viscosity of the droplets to increase. In contrast, as for the present embodiment, interaction between the pigment having an acid group and a basic pigment dispersant allows the viscosity of the droplets to be kept at an appropriate level. Therefore, the basic pigment dispersant can be used without disadvantage.

Here, the acid group is a sulfonic acid group (—$SO_3H$), a carboxylic acid group (—COOH), a phosphoric acid group ($H_2PO_4$—), a boric acid group ($H_2BO_3$—), or the like. Among these acid groups, sulfonic acid group or carboxylic acid group is particularly preferred, since they are highly effective in increasing the dispersibility. Regarding such an acid group, the number of acid groups introduced in one pigment molecule and the position where the acid group is introduced in the pigment molecule are not particularly limited. It is appropriate to select the number and the position of the acid group(s) so that the color of the pigment is not appreciably influenced. In the case where a plurality of acid groups are introduced in one pigment molecule, the introduced acid groups may be identical to each other or different from each other. Such a pigment having an acid group includes a variety of pigment derivatives or synergists, a compound (pigment) which is a known pigment in which an acid group is introduced, and the like.

The number and the position of the acid group(s) introduced in the pigment can be identified by adding the pigment to a solvent such as ketone-based solvent, stirring it, thereafter removing the supernatant liquid, and then performing potentiometric titration or the like.

Examples of the above-described known pigment in which an acid group is introduced may be a variety of organic pigments such as phthalocyanine-based, quinacridone-based, quinacridone quinone-based, isoindolinone-based, quinophthalone-based, diketo-pyrrolo-pyrrole-based, perylene-based, perinone-based, indigo-based, thioindigo-based, dioxazine-based, anthraquinone-based, pyranthrone-based, anthanthrone-based, flavanthrone-based, and indanthrone-based pigments, condensed polycyclic pigment such as metal complex-based pigment, benzimidazolone-based, insoluble azo-based, condensed azo-based, and soluble azo-based pigments, and the like. Examples of the known pigment also include carbon black in which an acid group is introduced, and carbon black of less than pH 7 (pH of pure water suspension of 5 mass % of carbon black) is considered as including such an acid group introduced therein. It should be noted that pigments that have been known as essentially having an acid group are also examples of the pigment having an acid group of the present embodiment.

This pigment having an acid group may be prepared by any of conventionally known methods, such as a method by which a sulfonating agent such as sulfuric acid or chlorosulfuric acid is caused to act on a known pigment to thereby introduce a sulfonic acid group in the pigment, for example. As the pigment having an acid group, any of commercially available products may be used. For example, commercially available synergists may include "SOLSPERSE 5000" (trademark) and "SOLSPERSE 12000" (trademark) manufactured by Lubrizol Japan Limited, and the like, and commercially available pigments having an acid group may include "FASTOGEN BLUE GBK-18SD" (trademark) and "FASTOGEN BLUE FDB-14" (trademark) manufactured by DIC corporation, and the like.

This pigment having an acid group included in the pigment in the toner particles is preferably 3 mass % or more, more preferably 10 mass % or more, with respect to the whole pigment included in the toner particles. If this pigment having an acid group is less than 3 mass %, the above-described effects will not sufficiently be obtained. In contrast, the upper limit of the pigment having an acid group may be 100 mass %, namely the pigment included in the toner particles may entirely be the pigment having an acid group. In the case where the pigment includes a pigment other than the pigment having an acid group, any of the above-listed known pigments may be used as the pigment other than the pigment having an acid group.

The content of the whole pigment included in the toner particles is not less than 8 mass % and not more than 70 mass %, more preferably not less than 10 mass % and not more than 50 mass %, with respect to the resin included in the toner particles. If the content of the pigment is less than 8 mass %, a desired image density may not be obtained and, if the content thereof is more than 70 mass %, the dispersibility of the pigment in the resin may be inadequate or the fixing strength may be weaker. An appropriate pigment content varies depending on the color. For example, the content of a cyan pigment is preferably not less than 10% and not more than 40 mass %, the content of a magenta pigment is preferably not less than 15 mass % and not more than 50 mass %, and the content of a yellow pigment is preferably not less than 8 mass % and not more than 70 mass % (these contents are each a content with respect to the resin in the toner particles). An appropriate content of the pigment also varies depending on the particle size of the toner particles, and a smaller particle size requires a higher content of the pigment.

<Pigment Dispersant>

The pigment dispersant included in the toner particles of the present embodiment is characterized by that the pigment dispersant is a basic polymer dispersant including units derived from ϵ-caprolactone. The pigment dispersant having such a structure accordingly acts as an adhesive component to significantly improve the strength of fixing the toner particles to a recording material such as paper. A basic pigment dispersant has an adequate adhesive action on a recording material such as paper. In particular, the basic pigment dispersant of a polymer structure including units derived from ϵ-caprolactone accordingly exerts a particularly excellent adhesive action. Moreover, since the basic polymer dispersant has such a polymer structure, remarkable interaction occurs between the basic polymer dispersant and the above-described pigment having an acid group, while the mechanism thereof has not sufficiently been elucidated. Consequently, excellent effects are produced, namely the dispersibility of the pigment in the toner particle is significantly improved and the viscosity of droplets of the granulation method is appropriately reduced.

It should be noted that such a pigment dispersant is preferably a pigment dispersant which not soluble in an insulating liquid described later herein. If the pigment dispersant is dissolved in the insulating liquid, the insulating liquid will undesirably be taken into the inside of toner particle to thereby weaken the fixing strength for the toner particles. It should also be noted that the toner particles of the present embodiment may include a pigment dispersant other than the pigment dispersant having the above-described structure, without going beyond the scope of the present invention.

Here, "including units derived from ϵ-caprolactone" means that the basic polymer dispersant, which is a polymer formed by polymerization (including ring-opening polymerization and polycondensation) of monomers, includes ϵ-caprolactone as at least one type of such monomers, and ϵ-caprolactone forms units of the polymer (namely basic polymer dispersant) after the polymerization reaction. "Basic polymer dispersant" is a polymer dispersant having a basic group in its molecule, and the basic group is amine group, amino group, amide group, pyrrolidone group, imine group, imino group, urethane group, quaternary ammonium group, ammonium group, pyridino group, pyridium group, imidazolino group, imidazolium group, or the like.

Thus, "a basic polymer dispersant including units derived from ϵ-caprolactone" may more specifically be a polymer compound including units derived from ϵ-caprolactone as a basic structure (main chain for example) and also having the above-described basic group. Specific examples of it may be polycaprolactone having any of the above-described basic groups, polycaprolactone-urethane graft polymer having any of the above-described basic groups, and the like. It should be noted that the ratio of the content of the basic group in the polymer compound and the position where the basic group is contained in the polymer compound are not particularly limited.

The structure of such a basic polymer dispersant including units derived from ϵ-caprolactone can be identified by means of NMR or the like.

Commercially available products of such a basic polymer dispersant including units derived from ϵ-caprolactone may for example be "SOLSPERSE 32000" (trademark), "SOLSPERSE 32500" (trademark), "SOLSPERSE 35100" (trademark), and "SOLSPERSE 37500" (trademark) of Lubrizol Japan Limited, "AJISPER PB-821" (trademark), "AJISPER PB-822" (trademark), and "AJISPER PB-881" (trademark) of Ajinomoto Fine-Techno Co., Inc., and the like.

The content of such a pigment dispersant included in the toner particles may be 1 to 100 mass %, preferably 1 to 40 mass % with respect to the total amount of the pigment in the toner particles. If the content of the pigment dispersant is less than 1 mass %, the dispersibility of the pigment may be inadequate and, if the content thereof is more than 100 mass %, the viscoelasticity of the toner particles in the completed toner may be weaker.

<Insulating Liquid>

As the insulating liquid included in the liquid developer of the present embodiment, an insulating liquid of high electrical insulation having a low dielectric constant of 3 or less is preferably used. For example, the insulating liquid may be selected from hydrocarbon-based compound (liquid paraffin), silicone oil, animal and vegetable oils, mineral oil, and the like.

<Toner Dispersant>

The liquid developer of the present embodiment preferably includes a dispersant (toner dispersant) which is soluble in the insulating liquid, in order to allow the toner particles to be dispersed stably in the insulating liquid. The type of such a toner dispersant is not particularly limited as long as it allows the toner particles to be dispersed stably. In the case where a polyester resin which is used as the resin included in the toner particles has a relatively large acid value, a polymer dispersant having a basic group is preferably used.

As such a basic group, at least one may be selected from the group consisting of amine group, amino group, amide group, pyrrolidone group, imine group, imino group, urethane group, quaternary ammonium group, ammonium group, pyridino group, pyridium group, imidazolino group, and imidazolium group. The basic group is preferably amine group, amino group, imine group, imino group, or pyrrolidone group.

Examples of such a polymer dispersant having a basic group may be polyamide and a salt thereof, polyalkylol amino amide and a salt thereof, high-molecular-weight unsaturated acid ester, modified polyurethane, modified polyester, vinyl pyrrolidone-based copolymer, polyoxyethylene alkyl phosphate ester, polyoxyethylene alkyl amine, polyester polyamine, polyamine fatty acid condensate, amino-modified silicone, and the like. In order to allow the toner particles to be adequately dispersed in the insulating liquid (non-polarized oil), a polymer dispersant having a long-chain alkyl group in its molecule is preferred.

Such a polymer dispersant may more specifically be as follows. A compound having an amide group may be "DISPERBYK-109 (alkylolamino amide)" (trademark) manufactured by BYK Chemie. A compound having a pyrrolidone group may be "V-216" (trademark), "V-220" (trademark), "W-660 (polyvinyl pyrrolidone having a long-chain alkyl group)" (trademark) manufactured by ISP Chemicals, or the like. Other examples may be "SOLSPERSE 11200" (trademark), "SOLSPERSE 13940" (trademark), "SOLSPERSE 17000" (trademark), "SOLSPERSE 18000" (trademark), and "SOLSPERSE 19000 (polyester polyamine)" (trademark) of Lubrizol Japan Limited, and the like.

As the above-described polymer dispersant, a compound having a urethane group is obtained by causing an acid or alcohol group to react with isocyanate. For example, as monomers constituting such a compound, acrylic acid, methacrylic acid, HEMA (hydroxy ethyl methacrylate) or the like may be used, and an end thereof may be caused to react with isocyanate to thereby obtain the compound.

It should be noted that such a toner dispersant may be dissolved in the insulating liquid or dispersed in the insulating liquid. Preferably, such a toner dispersant in a range of 0.5 mass % to 20 mass % with respect to the toner particles is preferably added. If the toner dispersant is less than 0.5 mass %, the dispersibility is deteriorated and, if the toner dispersant is more than 20 mass %, the toner dispersant takes the insulating liquid therein to thereby weaken the fixing strength of the toner particles depending on the case.

<Method for Manufacturing Liquid Developer>

The liquid developer of the present embodiment may be manufactured based on a conventionally known method such as granulation method, pulverization method, or the like. The manufacturing method is not particularly limited. However, the granulation method is one of most appropriate manufacturing methods, since the granulation method provides a higher energy efficiency and a smaller number of manufacturing steps as compared with the pulverization method. Such a granulation method is an appropriate manufacturing method as well in terms of the fact that small-size toner particles with a uniform particle size distribution can easily be obtained.

Such a granulation method may more specifically be suspension polymerization method, emulsion polymerization method, particle coagulation method, a method that adds a poor solvent to a resin solution and precipitates the resin, spray drying, or the like. Methods that are known as the polymerization method may be a method according to which water is used as a continuous phase and, after toner particles are prepared, the continuous phase is replaced with oil (insulating liquid), a method according to which toner particles are prepared by polymerization directly in the oil (insulating liquid), and the like.

Among a variety of granulation methods as described above, a preferred method is as follows, since this method can be used to obtain small-size toner particles with a particularly uniform particle size distribution. Specifically, a two-phase system is prepared that is made up of a dispersed phase and a continuous phase, where the dispersed phase is a dispersed liquid in which the pigment is dispersed in a resin solution prepared by dissolving the resin in a first solvent, and the continuous phase is a second solvent. Then the first solvent is vaporized from the dispersed phase to thereby obtain the toner particles. In this case, it is preferable that the dispersed phase includes the pigment dispersant and the first solvent has a solubility parameter value different from a solubility parameter value of the second solvent. In other words, the toner particles of the present embodiment are obtained by: preparing a two-phase system made up of a dispersed phase and a continuous phase, where the dispersed phase is a dispersed liquid in which the pigment is dispersed in a resin solution prepared by dissolving the resin in a first solvent, and the continuous phase is a second solvent; and vaporizing the first solvent from the dispersed phase. Preferably, the dispersed phase includes the pigment dispersant, and the first solvent has a solubility parameter value different from a solubility parameter value of the second solvent.

In the first solvent, the resin is dissolved. Therefore, the first solvent preferably has a solubility parameter value (SP value) in a range of 9 to 12. For example, acetone, methyl ethyl ketone, methyl isobutyl ketone, ethyl acetate, THF, or the like may be used as the first solvent. Among them, acetone is particularly preferred.

As the second solvent, usually the above-described insulating liquid may be used as it is. In particular, an insulating liquid having a solubility parameter value (SP value) in a range of 7 to 9 is preferably used as the second solvent.

More specifically, the pigment, the resin, and the pigment dispersant are first mixed with the first solvent to allow the resin to be dissolved in the first solvent. After this, the pigment is pulverized by means of bead mill or the like to thereby prepare a dispersed liquid (dispersed phase) in which the pigment is dispersed in the resin solution including the first solvent.

Next, in the insulating liquid which is the second solvent, the toner dispersant is dissolved or dispersed to form a continuous phase. Subsequently, the dispersed phase obtained in the above-described way is mixed with this continuous phase and they are sufficiently stirred by means of homomixer or the like to thereby prepare a two-phase system in which the dispersed phase is dispersed in the continuous phase. Then, in the two-phase system, the first solvent is vaporized from the dispersed phase. Accordingly, a liquid developer can be obtained in which the dispersed phase is the toner particles and the toner particles are dispersed in the second solvent (insulating liquid) which is the continuous phase.

<Image Forming Method>

The liquid developer of the present embodiment is used in wet-type image forming apparatuses based on wet electrophotography, such as copying machine, printer, digital printing machine, simplified printing machine, and the like, for forming an image. Generally, these wet-type image forming apparatuses use an electrophotographic image forming process in common. In the following, a wet-type image forming method using the liquid developer of the present embodiment will be described with reference to FIG. 1.

FIG. 1 shows an example of the overall configuration of a wet-type image forming apparatus. FIG. 1 mainly shows only the components involved in the image forming process, and shows the components involved in feeding, transporting, and discharging of the recording material in a simplified manner.

Wet-type image forming apparatus 10 in FIG. 1 includes a photoreceptor drum 1 serving as an image carrier, a charging device 2, an exposure device 3, a wet development device 4, and a cleaning device 6. Wet-type image forming apparatus 10 also includes an intermediate transfer roller 5, which serves as an intermediate transfer unit, and a secondary transfer roller 7.

While only one wet development device 4 is disposed in FIG. 1, a plurality of wet development devices may be disposed for forming a color image. The color development scheme, whether to perform intermediate transfer or not, and the like, may be determined in an arbitrary manner, and accordingly an arbitrary arrangement configuration may be employed.

While this wet-type image forming apparatus uses intermediate transfer roller 5, it may be in the form of an intermediate transfer belt. Photoreceptor drum 1 has a cylindrical shape having its surface on which a photoreceptor layer (not shown) is formed, and rotates in the direction indicated by an arrow A in FIG. 1. Along the outer periphery of photoreceptor drum 1, cleaning device 6, charging device 2, exposure device 3, wet development device 4, and intermediate transfer roller 5 are arranged in order in the direction in which photoreceptor drum 1 rotates. This system is capable of operating usually at 100 to 1000 mm/sec.

Charging device 2 causes the surface of photoreceptor drum 1 to be charged to a predetermined potential. Exposure device 3 irradiates the surface of photoreceptor drum 1 with light and lowers the charge level within the irradiated region to thereby form an electrostatic latent image.

Wet development device 4 develops the latent image formed on photoreceptor drum 1. Specifically, it transports the liquid developer to a development region of photoreceptor drum 1, and feeds toner particles included in the liquid developer to the electrostatic latent image on the surface of photoreceptor drum 1, to thereby form a toner image.

Wet development device 4 generally includes: a development roller 41 having its surface carrying a thin layer of the liquid developer for developing the latent image on photoreceptor drum 1 which is an image carrier; a transport roller 42 abutting on development roller 41 for transferring to the surface of development roller 41 the liquid developer with its amount adjusted; a feed roller 43 abutting on transport roller 42 for feeding liquid developer 8 in a developer tank 44 to the surface of transport roller 42; and a restriction blade 45 for adjusting the amount of supplied liquid developer 8.

In a development process, a development bias voltage of the same polarity as toner particles is applied from a power supply (not shown) to development roller 41 of wet development device 4. Depending on the balance between the bias voltage and the potential of the latent image on photoreceptor drum 1 which is also of the same polarity as the toner particles, a difference in magnitude between electric fields is generated. In accordance with the latent image, the toner particles in the developer are electrostatically adsorbed on photoreceptor drum 1 and accordingly the latent image on photoreceptor drum 1 is developed.

Intermediate transfer roller 5 is placed to face photoreceptor drum 1 and rotates in the direction of an arrow B while contacting photoreceptor drum 1. At a nip portion between intermediate transfer roller 5 and photoreceptor drum 1, primary transfer from photoreceptor drum 1 to intermediate transfer roller 5 is performed.

In the primary transfer process, a transfer bias voltage of the opposite polarity to the toner particles is applied from a power supply (not shown) to intermediate transfer roller 5. Accordingly, an electric field is formed between intermediate transfer roller 5 and photoreceptor drum 1 at a primary transfer position, and the toner image on photoreceptor drum 1 is electrostatically adsorbed on intermediate transfer roller 5 and transferred onto intermediate transfer roller 5.

As the toner image is transferred to intermediate transfer roller 5, cleaning device 6 removes residual toner particles on photoreceptor drum 1, and the subsequent image forming process is performed. Intermediate transfer roller 5 and secondary transfer roller 7 are arranged so that they face each other with a recording material 11 located therebetween, and rotate while contacting each other with recording material 11 therebetween. At a nip portion between intermediate transfer roller 5 and secondary transfer roller 7, secondary transfer from intermediate transfer roller 5 to recording material 11 is performed.

Recording material 11 is transported in the direction of an arrow C to a secondary transfer position at the timing adapted to the timing of secondary transfer. In the secondary transfer process, a transfer bias voltage of the opposite polarity to the toner particles is applied from a power supply (not shown) to secondary transfer roller 7. Accordingly, an electric field is formed between intermediate transfer roller 5 and secondary transfer roller 7, and the toner image on intermediate transfer roller 5 is electrostatically adsorbed on recording material 11 passing the portion between intermediate transfer roller 5 and secondary transfer roller 7, and transferred on recording material 11. As the toner image is transferred on recording material 11, cleaning device 6 removes residual toner particles on intermediate transfer roller 5, and the subsequent image forming process is performed.

A fixing unit 9 includes at least one pair of rollers that are arranged to face each other and rotate while contacting each other, and recording material 11 is pressurized under a high temperature condition. Accordingly, the toner particles forming the toner image on recording material 11 are fused and fixed on recording material 11.

EXAMPLES

In the following, the present invention will be described in more detail in connection with Examples. The present invention, however, is not limited to them.

<Manufacture of Polyester Resin A>

As a resin included in the toner particles, a polyester resin was manufactured in the following way.

In a round-bottom flask provided with a reflex condenser, a water-alcohol separator, a nitrogen gas feed pipe, a thermometer, and a stirring device, 1600 parts by mass of propylene oxide adduct of bisphenol A (mixture of compounds expressed by the above-indicated formula (I) where $R^1$ and $R^2$ each represent a propylene group, m and n each independently represent zero or a positive integer, and the sum of m and n is 1 to 16), and 890 parts by mass of terephthalic acid were placed, and stirred while nitrogen gas was fed, and polycondensation was performed at a temperature of 200 to 240° C. for five hours.

After this, the temperature was lowered to approximately 100° C., and 0.012 parts by mass of hydroquinone was added as a polymerization inhibitor to stop polycondensation, and accordingly obtain a polyester resin. The polyester resin thus obtained is referred to as "Polyester Resin A." The measured weight-average molecular weight (Mw) of Polyester Resin A was 8000, the acid value thereof was 10 mgKOH/g, and the glass transition temperature (Tg) thereof was 55° C.

<Manufacture of Polyester Resin B>

As a resin included in the toner particles, a polyester resin was manufactured in the following way.

In a round-bottom flask provided with a reflex condenser, a water-alcohol separator, a nitrogen gas feed pipe, a thermometer, and a stirring device, 1600 parts by mass of 1,6 hexanediol and 890 parts by mass of adipic acid were placed, and stirred while nitrogen gas was fed, and polycondensation was performed at a temperature of 200 to 240° C. for five hours.

After this, the temperature was lowered to approximately 100° C., and 0.012 parts by mass of hydroquinone was added as a polymerization inhibitor to stop polycondensation, and accordingly obtain a polyester resin. The polyester resin thus obtained is referred to as "Polyester Resin B." The measured weight-average molecular weight (Mw) of Polyester Resin B was 12000, and the acid value thereof was 10 mgKOH/g.

<Measurement of Weight-Average Molecular Weight (Mw)>

The weight-average molecular weight was measured by means of gel permeation chromatography (GPC) under the following conditions.

Detector: RI (refractive index) detector

Column: SHODEX KF-404HQ+SHODEX KF-402HQ (manufactured by Showa Denko K.K.)

Solvent: tetrahydrofuran

Flow rate: 0.3 ml/min

Calibration curve: standard polystyrene

<Measurement of Acid Value>

The acid value was measured under the conditions in accordance with a method defined by JIS K5400.

<Measurement of Glass Transition Temperature (Tg)>

The glass transition temperature (Tg) was measured by means of a differential scanning calorimeter (trademark: "DSC-6200" manufactured by Seiko Instruments Inc.) under the conditions that the sample amount was 20 mg and the temperature increase rate was 10° C./min.

<Manufacture of Pigment A Having Acid Group>

100 parts by mass of copper phthalocyanine (C.I. Pigment Blue 15:3) was added to 900 parts by mass of 98% concentrated sulfuric acid of normal temperature. Subsequently, they were heated, stirred at 85° C. for three hours, and thereafter poured in cold water to cause precipitation. The resultant precipitate was filtered and then washed with a saturated saline solution to thereby manufacture Pigment A having a sulfonic acid group as the acid group.

<Manufacture of Pigment B Having Acid Group>

100 parts by mass of C.I. Pigment Red 122 was added to 900 parts by mass of 98% concentrated sulfuric acid of normal temperature. Subsequently, they were heated, stirred at 85° C. for three hours, and thereafter poured in cold water to cause precipitation. The resultant precipitate was filtered and then washed with a saturated saline solution to thereby manufacture Pigment B having a sulfonic acid group as the acid group.

<Manufacture of Pigment C Having Acid Group>

100 parts by mass of C.I. Pigment Yellow 180 was added to 900 parts by mass of 98% concentrated sulfuric acid of normal temperature. Subsequently, they were heated, stirred at 85° C. for three hours, and thereafter poured in cold water to cause precipitation. The resultant precipitate was filtered and then washed with a saturated saline solution to thereby manufacture Pigment C having a sulfonic acid group as the acid group.

Example 1

100 parts by mass of Polyester Resin A, 20 parts by mass of C.I. Pigment Blue 15:3, 8 parts by mass of Pigment A having an acid group, 7 parts by mass of a basic polymer dispersant including units derived from s-caprolactone (trademark: "AJISPER PB-821" manufactured by Ajinomoto Fine-Techno Co., Inc., a compound having an amine group as an adsorption group and a caprolactone group in the main chain), 400 parts by mass of acetone (first solvent), and 100 parts by mass of zirconia beads were added to a sand mill and mixed for four hours to thereby prepare a dispersed liquid.

Meanwhile, 5 parts by mass of a toner dispersant (trademark: "SOLSPERSE 11200" manufactured by Lubrizol Japan Limited) was dissolved in 70 parts by mass of an insulating liquid (second solvent) (trademark: "IP SOLVENT 2028" manufactured by Idemitsu Chemicals), and a homogenizer was activated. Into the homogenizer being activated, 150 parts by mass of the prepared dispersed liquid as described above was placed and dispersed for five minutes to thereby prepare a liquid developer precursor which was a two-phase system in which a dispersed phase, which was the dispersed liquid, was dispersed in the continuous phase.

Subsequently, an evaporator was used to remove acetone from the liquid developer precursor to thereby obtain a liquid developer in which toner particles having a volume-average particle size of 3.2 μm were dispersed in the insulating liquid. The volume-average particle size was measured by means of a particle size distribution meter (trademark: "SALD2200" manufactured by Shimadzu Corporation) (the same method was used for the following Examples).

Example 2

86 parts by mass of Polyester Resin A, 14 parts by mass of Polyester Resin B, 25 parts by mass of C.I. Pigment Red 122, 2 parts by mass of Pigment B having an acid group, 7 parts by mass of a basic polymer dispersant including units derived from s-caprolactone (trademark: "AJISPER PB-822" manufactured by Ajinomoto Fine-Techno Co., Inc., a compound having an amine group as an adsorption group and a caprolactone group in the main chain), 400 parts by mass of acetone (first solvent), and 100 parts by mass of zirconia beads were added to a sand mill and mixed for four hours to thereby prepare a dispersed liquid.

Meanwhile, 5 parts by mass of a toner dispersant (trademark: "SOLSPERSE 11200" manufactured by Lubrizol Japan Limited) was dissolved in 70 parts by mass of an insulating liquid (second solvent) (trademark: "IP SOLVENT 2028" manufactured by Idemitsu Chemicals), and a homogenizer was activated. Into the homogenizer being activated, 150 parts by mass of the prepared dispersed liquid as described above was placed and dispersed for five minutes to thereby prepare a liquid developer precursor which was a two-phase system in which a dispersed phase, which was the dispersed liquid, was dispersed in the continuous phase.

Subsequently, an evaporator was used to remove acetone from the liquid developer precursor to thereby obtain a liquid developer in which toner particles having a volume-average particle size of 2.5 μm were dispersed in the insulating liquid.

Regarding the above-described resin mixture of Polyester Resin A and Polyester Resin B, the total amount of units derived from an aliphatic monomer included in the total amount of units derived from an acid component and units derived from an alcohol component was 30 mol %. The ratio of the content of the units of each component in the polyester resin (including the total amount of units derived from an aliphatic monomer) can be determined by using a Fourier transform nuclear magnetic resonance apparatus (FT-NMR) (trademark: "LAMBDA 400" manufactured by JEOL Ltd.) and conducting 1H-NMR analysis to obtain the integration ratio from which the ratio of the content is derived. As a solvent for measurement, chloroform-d (deuterated chloroform) solvent may be used.

Example 3

40 parts by mass of Polyester Resin A, 60 parts by mass of Polyester Resin B, 35 parts by mass of C.I. Pigment Yellow 180, 2 parts by mass of Pigment C having an acid group, 7 parts by mass of a basic polymer dispersant including units derived from ϵ-caprolactone (trademark: "AJISPER PB-821" manufactured by Ajinomoto Fine-Techno Co., Inc.), 400 parts by mass of acetone (first solvent), and 100 parts by mass of zirconia beads were added to a sand mill and mixed for four hours to thereby prepare a dispersed liquid.

Meanwhile, 5 parts by mass of a toner dispersant (trademark: "SOLSPERSE 11200" manufactured by Lubrizol Japan Limited) was dissolved in 70 parts by mass of an insulating liquid (second solvent) (trademark: "IP SOLVENT 2028" manufactured by Idemitsu Chemicals), and a homogenizer was activated. Into the homogenizer being activated, 150 parts by mass of the prepared dispersed liquid as described above was placed and dispersed for five minutes to thereby prepare a liquid developer precursor which was a two-phase system in which a dispersed phase, which was the dispersed liquid, was dispersed in the continuous phase.

Subsequently, an evaporator was used to remove acetone from the liquid developer precursor to thereby obtain a liquid developer in which toner particles having a volume-average particle size of 1.8 μm were dispersed in the insulating liquid.

Regarding the above-described resin mixture of Polyester Resin A and Polyester Resin B, the total amount of units derived from an aliphatic monomer included in the total amount of units derived from an acid component and units derived from an alcohol component was 80 mol %.

Example 4

100 parts by mass of Polyester Resin A, 20 parts by mass of a pigment having an acid group (trademark: "FASTOGEN BLUE GBK-18SD" manufactured by DIC corporation), 7 parts by mass of a basic polymer dispersant including units derived from ϵ-caprolactone (trademark: "AJISPER PB-821" manufactured by Ajinomoto Fine-Techno Co., Inc.), 400 parts by mass of acetone (first solvent), and 100 parts by mass of zirconia beads were added to a sand mill and mixed for four hours to thereby prepare a dispersed liquid.

Meanwhile, 5 parts by mass of a toner dispersant (trademark: "SOLSPERSE 11200" manufactured by Lubrizol Japan Limited) was dissolved in 70 parts by mass of an insulating liquid (second solvent) (trademark: "IP SOLVENT 2028" manufactured by Idemitsu Chemicals), and a homogenizer was activated. Into the homogenizer being activated, 150 parts by mass of the prepared dispersed liquid as described above was placed and dispersed for five minutes to thereby prepare a liquid developer precursor which was a two-phase system in which a dispersed phase, which was the dispersed liquid, was dispersed in the continuous phase.

Subsequently, an evaporator was used to remove acetone from the liquid developer precursor to thereby obtain a liquid developer in which toner particles having a volume-average particle size of 3.2 μm were dispersed in the insulating liquid.

Example 5

100 parts by mass of Polyester Resin A, 20 parts by mass of C.I. Pigment Blue 15:3, 2 parts by mass of a pigment having an acid group (trademark: "SOLSPERSE 12000" manufactured by Lubrizol Japan Limited), 7 parts by mass of a basic polymer dispersant including units derived from ϵ-caprolactone (trademark: "AJISPER PB-821" manufactured by Ajinomoto Fine-Techno Co., Inc.), 400 parts by mass of acetone (first solvent), and 100 parts by mass of zirconia beads were added to a sand mill and mixed for four hours to thereby prepare a dispersed liquid.

Meanwhile, 5 parts by mass of a toner dispersant (trademark: "SOLSPERSE 11200" manufactured by Lubrizol Japan Limited) was dissolved in 70 parts by mass of an insulating liquid (second solvent) (trademark: "IP SOLVENT 2028" manufactured by Idemitsu Chemicals), and a homogenizer was activated. Into the homogenizer being activated, 150 parts by mass of the prepared dispersed liquid as described above was placed and dispersed for five minutes to thereby prepare a liquid developer precursor which was a two-phase system in which a dispersed phase, which was the dispersed liquid, was dispersed in the continuous phase.

Subsequently, an evaporator was used to remove acetone from the liquid developer precursor to thereby obtain a liquid developer in which toner particles having a volume-average particle size of 3.2 μm were dispersed in the insulating liquid.

Example 6

100 parts by mass of Polyester Resin A, 25 parts by mass of C.I. Pigment Blue 15:3, 8 parts by mass of Pigment A having an acid group, and 5 parts by mass of a basic polymer dispersant including units derived from s-caprolactone (trademark: "AJISPER PB-821" manufactured by Ajinomoto Fine-Techno Co., Inc.) were sufficiently mixed by means of a HENSCHEL MIXER.

Subsequently, this mixture was melted and mixed by means of a twin-shaft extruder, thereafter cooled and then roughly pulverized. Following this, the roughly pulverized mixture was finely pulverized by means of a jet pulverizer so that the volume-average particle size became 6 μm, to thereby obtain toner particles.

Following this, 30 parts by mass of the toner particles obtained in the above-described way, 2 parts by mass of a toner dispersant (trademark: "SOLSPERSE 11200" manufactured by Lubrizol Japan Limited), 70 parts by mass of an insulating liquid (trademark: "IP SOLVENT 2028" manufactured by Idemitsu Chemicals), and 100 parts by mass of zirconia beads were mixed at this ratio, and stirred by means of a sand mill for 120 hours to thereby manufacture a liquid developer. The toner particles included in this liquid developer had a volume-average particle size of 2.3 μm.

Comparative Example 1

A liquid developer was obtained in the same way as Example 1, except that Pigment A having an acid group of Example 1 was not used. The toner particles included in this liquid developer had a volume-average particle size of 11.2 μm.

Comparative Example 2

A liquid developer was obtained in the same way as Example 1, except that 7 parts by mass of a basic polymer dispersant including units derived from ϵ-caprolactone of Example 1 was replaced with 14 parts by mass of an acid dispersant (trademark: "SOLSPERSE 44000" manufactured by Lubrizol Japan Limited, having a chemical structure in which a polymer compound having an acid group is contained and the active component is 50%). The toner particles included in this liquid developer had a volume-average particle size of 3.2 μm.

Comparative Example 3

A liquid developer was obtained in the same way as Example 6, except that the basic polymer dispersant including units derived from ϵ-caprolactone of Example 6 was not used. The toner particles included in this liquid developer had a volume-average particle size of 3.3 μm.

<Evaluation>

Regarding respective liquid developers obtained for the above-described Examples and Comparative Examples, the fixing strength, the pigment dispersibility, and the volume-average particle size of toner particles were evaluated in the following way.

<Evaluation of Fixing Strength>

Each liquid developer fixed on a recording material was used as a fixing sample, and the fixing strength of the sample was evaluated based on a tape peel test as follows.

First, each liquid developer was placed in developer tank 44 of FIG. 1, and a monochrome solid pattern (10 cm×10 cm, the amount of attached toner particles: 1.2 mg/m$^2$) was formed on coated paper used as the recording material, under the conditions that the NIP time for which the paper was passed between the fixing roller and the pressure roller was 60 msec, and the temperature of the surface of the fixing roller was 180° C., to thereby obtain a fixing sample.

Subsequently, a tape was attached to each fixing sample and then peeled off. The amount of toner particles transferred from the paper to the peeled-off tape was measured for use as an image density (ID).

More specifically, a tape of 20 mm in width (trademark: "SCOTCH MENDING TAPE 810" manufactured by the 3M Company) was attached to an image face (about 50 mm in length) of the fixing sample, and the tape surface was pressed sufficiently with a finger. After this, the tape was peeled off and the peeled-off tape was attached to paper "CF-80" (trademark) manufactured by Konica Minolta Business Solutions. Subsequently, on "CF-80" to which the tape was attached, the ID of the portion where toner particles did not stick was calibrated to zero and the ID of the portion where toner particles stuck was measured with an ID meter (trademark "SPECTROEYE LT" manufactured by X-Rite Inc.). An ID of not more than 0.05 was evaluated as "A," an ID of more than 0.05 and not more than 0.1 was evaluated as "B," an ID of more than 0.1 and not more than 0.2 was evaluated as "C," and an ID of more than 0.2 was evaluated as "D." A smaller numerical value of the ID represents a superior fixing strength. The results are shown in Table 1.

<Evaluation of Pigment Dispersibility>

Regarding Examples 1 to 5 and Comparative Examples 1 to 2, the volume-average particle size of the pigment in the dispersed liquid was measured by means of a dynamic light-scattering particle size distribution analyzer (trademark: "LB-500" manufactured by Horiba, Ltd.).

Regarding Example 6 and Comparative Example 3, the roughly pulverized mixture was cut by means of a microtome, and a resultant cross section was observed with a transmission electron microscope to thereby determine the average particle size of 50 pigment particles.

The dispersibility was evaluated based on the criteria that an average particle size of less than 200 nm was "A," an average particle size of not less than 200 nm and less than 500 nm was "B," and an average particle size of not less than 500 nm was "C." A smaller particle size represents superior pigment dispersibility. The results are shown in Table 1.

<Volume-Average Particle Size of Toner Particles>

As described above, the volume-average particle size of toner particles in each liquid developer was measured by means of a particle size distribution meter (trademark: "SALD 2200" manufactured by Shimadzu Corporation). The volume-average particle size was evaluated based on the criteria that a volume-average particle size of not more than 5 μm was "A" and a volume-average particle size of more than 5 μm was "B." A smaller volume-average particle size is more desirable in terms of improvement of the image quality. The results are shown in Table 1.

TABLE 1

| | Evaluation of Pigment Dispersibility | Evaluation of Fixing Strength | Volume-Average Particle Size of Toner Particles |
|---|---|---|---|
| Example 1 | A | B | A |
| Example 2 | A | A | A |
| Example 3 | A | A | A |
| Example 4 | A | B | A |
| Example 5 | A | B | A |
| Example 6 | B | B | A |
| Comparative Example 1 | C | B | B |
| Comparative Example 2 | B | D | A |
| Comparative Example 3 | C | D | A |

As clearly seen from Table 1, it has been confirmed that the liquid developers of the Examples provide both the improvement of the dispersibility of the pigment in the toner particle and the improvement of the fixing strength, and are also superior in productivity, as compared with the liquid developers of the Comparative Examples.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A liquid developer comprising toner particles and an insulating liquid, wherein said toner particles include a resin, a pigment, and a pigment dispersant, said pigment includes an organic pigment having an acid group, and said pigment dispersant is a basic polymer dispersant including units derived from ϵ-caprolactone in a main chain of the basic polymer.

2. A liquid developer comprising toner particles and an insulating liquid, wherein said toner particles include a resin, a pigment, and a pigment dispersant, said pigment includes a pigment having an acid group, said pigment dispersant is a basic polymer dispersant including units derived from ϵ-caprolactone, said resin includes a polyester resin including units derived from an acid component and units derived from an alcohol component, and a total amount of units derived from an aliphatic monomer included in the units derived from an acid component and the units derived from an alcohol component is 30 to 80 mol %, and the alcohol component is represented by formula (I):

(1)

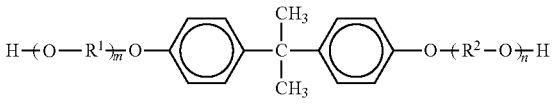

wherein $R^1$ and $R^2$ each independently represents an alkylene group having 2 or 3 carbon atoms, m and n each independently represents zero or a positive integer, and a sum of m and n is 1 to 16.

3. The basic polymer dispersant according to claim 1, wherein the main chain of the basic polymer comprises only the units derived from ϵ-caprolactone as repeating units.

* * * * *